US010209001B2

(12) United States Patent
Laible

(10) Patent No.: US 10,209,001 B2
(45) Date of Patent: Feb. 19, 2019

(54) DOMESTIC REFRIGERATOR WITH A DISPENSING UNIT WITH TWO CLOSURE ELEMENTS ON A DISCHARGE CHANNEL

(71) Applicant: BSH HAUSGERAETE GMBH, Munich (DE)

(72) Inventor: Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 176 days.

(21) Appl. No.: 15/129,889

(22) PCT Filed: Mar. 2, 2015

(86) PCT No.: PCT/EP2015/054311
§ 371 (c)(1),
(2) Date: Sep. 28, 2016

(87) PCT Pub. No.: WO2015/150003
PCT Pub. Date: Oct. 8, 2015

(65) Prior Publication Data

US 2017/0131023 A1 May 11, 2017

(30) Foreign Application Priority Data

Mar. 31, 2014 (DE) ..... 10 2014 206 089

(51) Int. Cl.
*F25D 23/12* (2006.01)
*F25D 29/00* (2006.01)

(52) U.S. Cl.
CPC ..... *F25D 23/126* (2013.01); *F25D 23/12* (2013.01); *F25D 29/00* (2013.01)

(58) Field of Classification Search
CPC .. F25C 5/20; F25C 5/22; F25D 23/028; F25D 23/12; F25D 23/126; F25D 29/00
See application file for complete search history.

(56) References Cited

U.S. PATENT DOCUMENTS 3,789,620 A * 2/1974 Benasutti ..... F25C 5/005 222/456
3,934,691 A * 1/1976 Toloczko ..... B65D 90/54 193/32

(Continued)

FOREIGN PATENT DOCUMENTS

DE 202006013708 U1 11/2006
KR 1020090013573 A 2/2009
WO 2010123175 A1 10/2010

*Primary Examiner* — Marc E Norman
(74) *Attorney, Agent, or Firm* — Laurence A. Greenberg; Werner H. Stemer; Ralph E. Locher

(57) ABSTRACT

A domestic refrigerator includes a housing surrounding a receiving area for food and a dispensing unit disposed in the housing. The dispensing unit is constructed to dispense refrigerated pourable goods and has a container for receiving the refrigerated goods and a discharge channel coupled to the container for discharging the refrigerated goods from the container to the exterior of the housing. A first closure element is provided for closing the discharge channel. A second closure element, which is separate from the first closure element, is also provided for closing the discharge channel. The second closure element lies closer to the container than the first closure element when viewed along the discharge channel.

12 Claims, 5 Drawing Sheets

(56) References Cited

U.S. PATENT DOCUMENTS 8,690,027 B2 * 4/2014 Berger ..... F25C 5/22
222/504
8,806,884 B2 8/2014 Park et al.

* cited by examiner

DOMESTIC REFRIGERATOR WITH A DISPENSING UNIT WITH TWO CLOSURE ELEMENTS ON A DISCHARGE CHANNEL

BACKGROUND OF THE INVENTION

Field of the Invention

The invention relates to a domestic refrigerator having a housing which surrounds a receiving area for food, and having a dispensing unit arranged on the housing, which dispensing unit is designed to dispense refrigerated pourable goods. The dispensing unit has a container for receiving the refrigerated goods and a discharge channel which is coupled to the container for discharging the refrigerated goods from the container to the exterior of the housing. The dispensing unit furthermore comprises a first closure element for closing the discharge channel.

Such a domestic refrigerator, which has an ice or water dispenser, is known for example from DE 20 2006 013 708 U1. The ice or water dispenser in this case is integrated in a door and arranged separated from a receiving area in which food is placed. The water tank is connected to a delivery line which is associated with a dispensing facility, by means of which the water taken from the water tank can then be drawn off and can in particular then be introduced into a drinking vessel arranged in the dispensing compartment. The water tank is connected by way of a feed line and a nonreturn valve to a liquid supply external to the device in the form of a domestic water supply system.

Said domestic refrigerator furthermore comprises a delivery tube for ice, by means of which refrigerated pourable goods in the form of the ice cubes from an ice maker can be delivered into a collection container located downstream therefrom, and delivered from said collection container to the exterior of the housing into the dispensing compartment embodied in the door. At one end of the delivery tube facing away from the collection container and leading to the exterior said embodiment furthermore comprises a flap which can be moved relative to the delivery tube and thereby allows the delivery tube to be closed and opened at said end leading to the exterior.

Said discharge channel is a critical interface in respect of the thermal insulation of the domestic refrigerator and a heat input from the exterior into the device may occur. The flap at the outlet of said delivery tube or of the discharge channel is however normally relatively thin and therefore offers relatively poor thermal insulation. As a result, heat also enters the channel and the device by way of said opening location and can thereby reduce the energy efficiency. On the basis of embodiments of otherwise known devices in which said flap is very thin and offers no thermal insulation condensation occurs at the cold surfaces produced there.

In this situation it is also known that said thin plates are then heated in order to prevent said condensation, which does however in turn reduce the energy efficiency of the device.

It is moreover known that the dispensing unit is likewise heated in the region of the discharge channel adjacent to said outlet opening. As a result of the configuration of the dispensing unit, low surface temperatures are encountered in said region, thereby giving rise to locations at which condensation occurs on the surface. Attempts are also made in the known embodiments to reduce or prevent said condensation by means of a heating facility, which then likewise has a disadvantageous effect on the energy efficiency of the domestic refrigerator.

BRIEF SUMMARY OF THE INVENTION

The object of the present invention is to create a domestic refrigerator in which a more energy-efficient operation is achieved and an undesired heat input by way of such a discharge channel for refrigerated goods is at least reduced.

This object is achieved by a domestic refrigerator in accordance with the features of claim 1.

A domestic refrigerator according to the invention comprises a receiving area for food, which receiving area is surrounded by a housing. The domestic refrigerator furthermore comprises a dispensing unit arranged in the housing, which dispensing unit is designed to dispense refrigerated pourable goods. The dispensing unit comprises a container for receiving the refrigerated goods and a discharge channel which is coupled to the container for discharging the refrigerated goods from the container to the exterior of the housing. The dispensing unit furthermore comprises a first closure element for closing the discharge channel. An important concept of the invention can be seen in the fact that a second closure element separate from the first closure element is arranged for closing the discharge channel, which second closure element is arranged lying closer to the container than the first closure element. By means of this plurality of separate closure elements and the local position of the second closure element it is possible to improve the thermal insulation effect especially in the region of the discharge channel. The energy efficiency of the domestic refrigerator is thereby likewise improved.

Provision is preferably made that the second closure element is arranged at an end of the discharge channel facing the container and is thereby positioned quasi at an inlet of the discharge channel in respect of the pouring direction of the refrigerated goods towards the exterior. This is a particularly advantageous embodiment because an improved thermal insulation effect is thereby achieved by the closure element at precisely this exposed location and the discharge channel is thereby thermally insulated quasi within the housing at its inlet by said additional closure element. With regard to its length it thereby offers improved decoupling in respect of the thermal insulation quasi preferably already at the inlet or at the beginning of the discharge channel towards the exterior.

In particular, provision is made that the second closure element is arranged such at the end of the discharge channel facing the container that it is arranged projecting in certain zones from the discharge channel beyond said end to the exterior. This is particularly advantageous insofar as the accessibility of the second closure element is thereby also improved and is thus very exposed and freely accessible in certain zones for assembly purposes or even for removal purposes. Furthermore, this embodiment also makes possible a mechanically stable and positionally accurate arrangement of the second closure element, such that in the closed state a mechanical contacting particularly worthy of mention is also given between the second closure element and the discharge channel, such that the thermal insulation effect is also promoted here.

Provision is preferably made that the second closure element is designed in the form of a plug. This embodiment also makes it possible for the second closure element to protrude into the discharge channel to a certain extent, such that the positionally secure arrangement is improved and also that the sealing is promoted.

In an alternative advantageous embodiment, provision is made that the second closure element is designed for independent automatic closing and opening. With this embodiment, the second closure element can then be moved, in particular in controlled fashion, relative to the discharge channel, such that the closed and the opened condition can accordingly be achieved user-independently and without direct manual intervention of the user touching the second closure element.

For example, the second closure element can be moved appropriately by means of a motor.

The second closure element can in particular in this context be a swivel-mounted flap. It can however for example also be a component composed of a plurality of fan elements or slat elements, which can then be moved in similar fashion to a roller blind and can thus in particular then also be moved over this end of the discharge channel facing the container, and accordingly forms a cover.

Other embodiments of a second closure element are furthermore made possible, wherein the closure element can here for example also consist of at least two subcomponents which can then be moved in opposite directions for opening and can be moved towards each other for closing. By this means it is also possible to achieve a certain overlapping of said subcomponents in the closed state, as a result of which the thermal insulation effect can be further improved.

Provision is preferably made that the domestic refrigerator has an electronic control unit which controls the automatic movement of the second closure element depending on an output request to output refrigerated goods from the container and which controls the closure of the second closure element after output of the refrigerated goods has taken place. By means of such an additional control unit and the opening and closing of the second closure element which thus take place automatically this movement is performed in yet more needs-based fashion and is better adapted to a specific situation, such that an advantageous embodiment is achieved here in respect of the thermal insulation effect in the region of the discharge channel.

This embodiment in particular prevents the situation in which it is forgotten to insert or fit such a second closure element, which should the situation arise may be the case with only one second closure element which can be removed manually.

It is particularly advantageous that the domestic refrigerator has a detection unit by means of which the position of the second closure element can be ascertained. In particular, the position of the second closure element relative to the discharge channel can be detected in this situation. This is a particularly preferred embodiment insofar as it serves to monitor whether said second closure element is arranged in the closed or opened state at said specific position relative to the discharge channel. This embodiment then also serves to prevent the situation that in the event of an output request for refrigerated goods said refrigerated goods are then output from the container but are unable to enter the discharge channel on account of the closed second closure element, which could possibly result in damage to the domestic refrigerator. With regard to an embodiment which is therefore very advantageous, provision is made that in particular when an output request has occurred and a second closure element is closed said output of refrigerated goods is initially prevented or suppressed under the control of a control unit. This is moreover a particularly advantageous embodiment insofar as said second closure element cannot be opened and closed under automatic control but can only be manually removed and inserted again by a user.

In an advantageous embodiment, provision is made that the detection unit is designed at least for inductive or capacitive detection at least of the closed condition of the second closure element, in particular also for detection of the opened condition of the second closure element. In a further embodiment, provision can be additionally or alternatively be made that said detection unit is designed at least for magnetic detection at least of the closed condition of the second closure element, in particular also for detection of the opened condition.

In particular in the case of inductive or capacitive or magnetic detection it is advantageous if in this respect a first detection element is arranged on the second closure element itself and a second detection element corresponding thereto technically is arranged externally to the closure element and for example is positioned directly on the discharge channel itself.

Provision can also be made that the detection unit is designed for optical detection at least of the closed condition of the second closure element, in particular also for detection of the opened condition. Said detection can be formed for example by means of infrared signals or signals in the human-visible spectral range. A transmitter/receiver configuration can for example also be provided here.

In the case of magnetic detection, permanent magnets are preferably provided as detection elements but magnetically acting sensors, such as for example a Hall sensor, can also be provided.

Provision is preferably made that the domestic refrigerator has a control unit which suppresses an output of refrigerated goods depending on the detection of the at least closed condition of the second closure element and in this situation in particular keeps closed an output opening on the container. The advantages which can be achieved thereby have already been stated above.

Provision is preferably made that the domestic refrigerator has a control unit which, depending on the detection of the closed condition of the second closure element, controls a heat output from a heater unit which is designed and arranged in order to heat the discharge channel. Additionally or alternatively, provision can be made that the control unit controls a heat output from a heater unit in order to heat the first closure element. These embodiments are particularly advantageous insofar as the heating facilities are preferably also present in order to at least reduce the condensation already mentioned in the introduction. Particularly with regard to these exemplary embodiments, the configuration according to the invention having a second closure element and the specific positional arrangement thereof are then particularly advantageous. On the one hand the condensation can thereby at least be further reduced, on the other hand the heat input into the domestic refrigerator by way of the discharge channel can be reduced and moreover the energy-efficient operation of the domestic refrigerator can be improved, which results not only thanks to the reduction in heat output of the at least one stated heater unit. This is because this second closure element and the specific local position thereof preferably serve to ensure that the heat outputs of said at least one heater unit can be reduced in comparison with previous designs and then at least the same reduction in condensation is achieved.

Provision is preferably made that the second closure element has a thermally insulating element at least on the side facing the first closure element. By means of this embodiment the thermal insulation effect is further improved especially at the transition between the second closure element and the discharge channel, in particular at the end of the discharge channel facing the container. Furthermore, said thermally insulating element can also serve as a carrier for a detection element which is part of a detection unit already mentioned above, by means of which the position or situation of the second closure element can then be determined. This means that said detection element can be arranged in positionally accurate and mechanically stable fashion and where applicable also with thermal protection and shock resistance or scratch protection.

Provision is preferably made that the first closure element is arranged at an end of the discharge channel facing away from the container and is thus arranged quasi at an outlet of the discharge channel embodied in the direction of discharge of the refrigerated goods. By means of said positional arrangements of the first and second closure elements the discharge channel is quasi closed at its ends if no output of the refrigerated goods is able to take place, which means that it is then encapsulated and sealed up quasi over its entire length at the maximally spaced positions, which means that the above-mentioned advantages take effect to a particular degree.

Further features of the invention will emerge from the claims, the figures and the description of the figures. The features and combinations of features stated above in the description as well as the features and combinations of features stated below in the description of the figures and/or shown by themselves in the figures can be used not only in the combination specified in each case but also in other combinations or in isolation without departing from the scope of the invention. Embodiments of the invention which are not explicitly shown and explained in the figures but emerge from and can be produced by separated combinations of features from the described embodiments are thus also to be regarded as included and disclosed.

BRIEF DESCRIPTION OF THE SEVERAL VIEWS OF THE DRAWING

Exemplary embodiments of the invention will be described in detail in the following with reference to schematic drawings. In the drawings.

DESCRIPTION OF THE INVENTION

Figure 1:
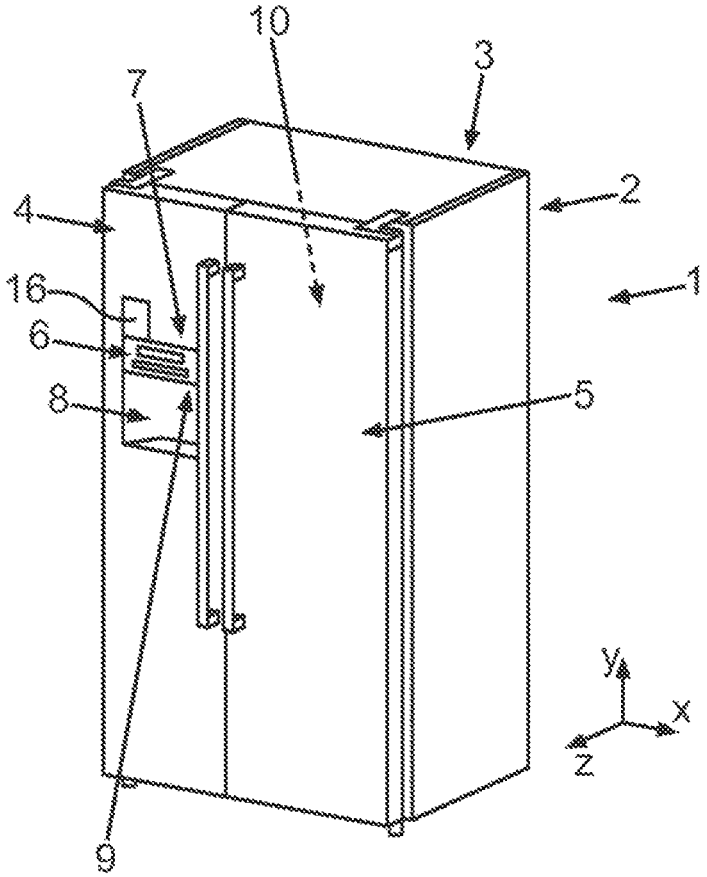
FIG. 1 shows a perspective illustration of an exemplary embodiment of a domestic refrigerator according to the invention.

The same elements or elements having the same function are identified by the same reference characters in the figures.

FIG. 1 shows a perspective illustration of a domestic refrigerator 1 which can be a refrigerator or a freezer or a refrigerator/freezer combination. The domestic refrigerator 1 comprises a housing 2 which delimits a receiving area 10. The housing 2 comprises a body 3 and in the exemplary embodiment doors 4 and 5 arranged in swiveling fashion thereon. The doors 4, 5 are arranged in order to close the receiving area 10. The domestic refrigerator 1 furthermore comprises a dispensing unit 6 which is designed at least to dispense refrigerated pourable goods, in particular ice cubes, and preferably also to dispense cooled liquid. The dispensing unit 6 is arranged in the housing 2, wherein it can be arranged having at least subcomponents in the receiving area 10 and/or having subcomponents at least in a wall of the body 3 or a door 4 or it can be arranged completely in such a wall and can thus be arranged separated from the receiving area 10.

The dispensing unit 6 comprises an operating and display device 7 which is accessible and can be viewed on a front panel of the door 4. In order to dispense the refrigerated goods the user of the domestic refrigerator 1 can then insert a receiving vessel, such as for example a drinking glass etc., into a dispensing compartment 8 of the door 4, and the refrigerated goods can then drop into said vessel by way of an illustrated dispensing facility 9 of the dispensing unit 6.

In addition to the aforementioned dispensing facility 9 the dispensing unit 6 preferably comprises a container connected in fluid-conducting and liquid-conducting fashion to the dispensing facility 9, in which container the liquid is contained. The dispensing facility 9 extends partially into the dispensing compartment 8 and can be operated by way of the operating and display device 7.

Figure 2:
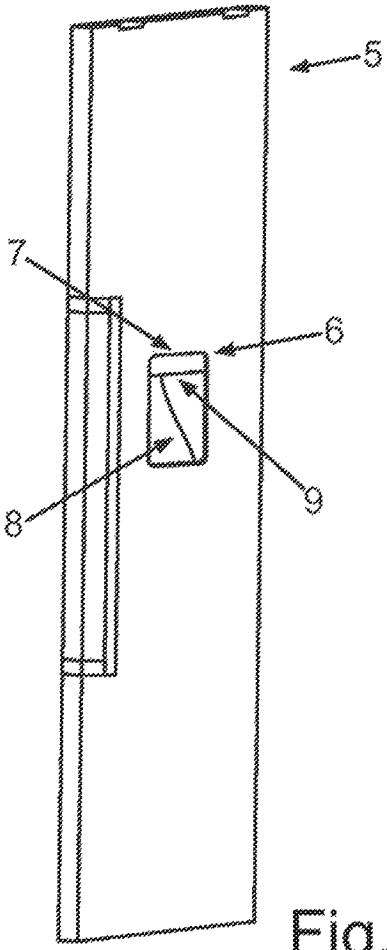
FIG. 2 shows a perspective illustration of an exterior view of a door of the domestic refrigerator according to FIG. 1.

FIG. 2 shows a perspective illustration of the door 5, wherein in this exemplary embodiment in contrast to the illustration in FIG. 1 the dispensing unit 6 is configured on said door 5.

Figure 3:
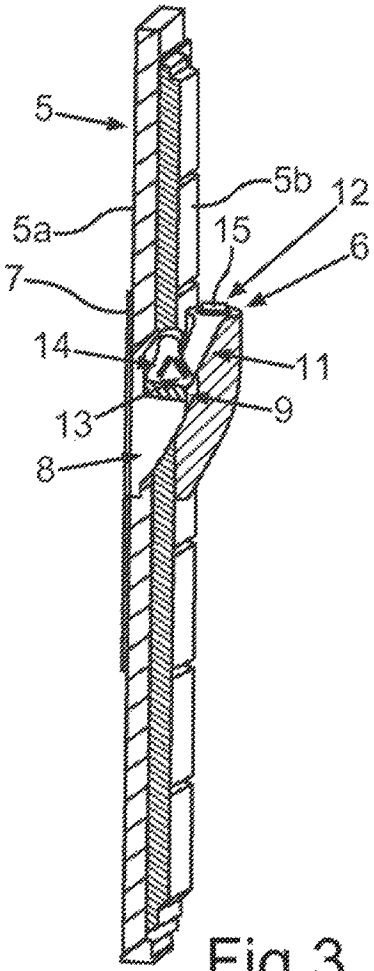
FIG. 3 shows a perspective sectional view of the door according to FIG. 2.

FIG. 3 shows the door 5 once again in a perspective sectional view.

It can be seen in this case that the dispensing compartment 8 is freely accessible by way of an outer surface 5*a* of the door 5 facing away from the receiving area 10. Opposite that, an inner surface 5*b* of the door 5 is configured to bulge in the direction of the receiving area 10 in the area of a discharge channel 11 of the dispensing unit 6.

The discharge channel 11 is inclined obliquely downward and forward, starting from an end 12 which faces away from the dispensing compartment 8 and faces a container not yet shown in FIG. 3. The container is preferably arranged above an opening leading into the discharge channel 11 at this upper first end 12 of the discharge channel 11.

For example, the container 23 with the refrigerated pourable goods can be configured positionally in accordance with the arrangement in the cited prior art. In addition, an ice crusher cited in the prior art can then also be configured, by way of which the refrigerated pourable goods produced then enter the cited container 23 and there are likewise moved, for example by means of a screw conveyor, towards the output opening of the container 23, and from there can then enter the end 12 of the discharge channel 11 forming an inlet.

The discharge channel 11 furthermore comprises an end 13 situated opposite the end 12 situated closer to the container, which end 13 faces the dispensing compartment 8. Said end 13 then quasi forms the outlet of the discharge channel 11, whereas the end 12 forms the inlet, where this is to be understood with regard to the pouring direction of the refrigerated goods from the collection container to the dispensing compartment 8.

The dispensing unit 6 comprises a first closure element 14 which is arranged in the dispensing compartment 8 and is arranged for opening and closing the end 13 of the discharge channel 11.

The dispensing unit 6 furthermore comprises a second closure element 15 which is arranged locally at the end 12 and is designed for closing and opening the end 12. The two closure elements 14 and 15 are thus arranged directly at the ends 13 and 12.

Figure 4:
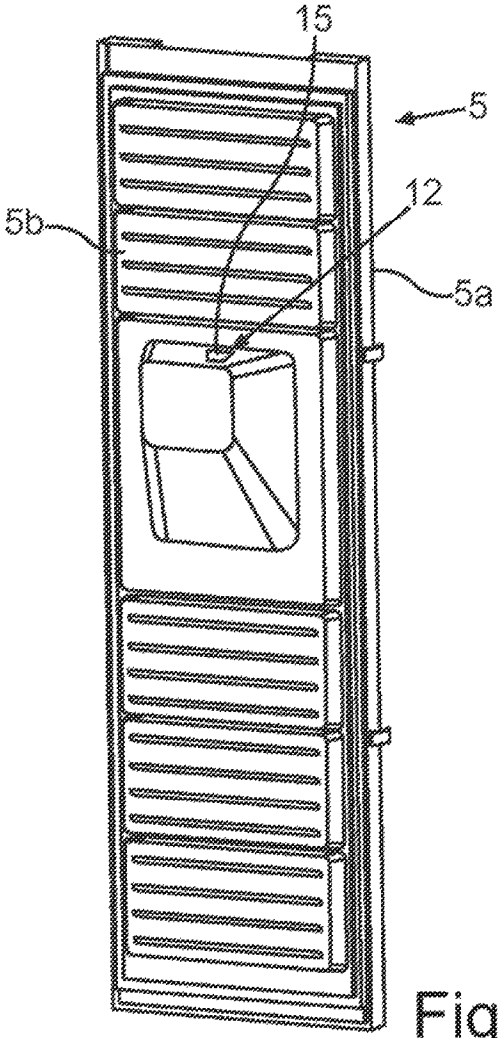
FIG. 4 shows a perspective view of an inner surface of the door according to FIG. 2 and FIG. 3.

FIG. 4 shows a perspective illustration of the door 5 with a view of the inner surface 5*b*. The bulge in the region of the discharge channel 11 can be seen, and the upper end 12 of the discharge channel with the second closure element 15 shown by way of example and symbolically can also be seen.

The domestic refrigerator 1 comprises a control unit 16, which is illustrated only symbolically in FIG. 1 and the position and size are to be understood only as an example. Said control unit 16 is provided in an exemplary embodiment in order to control the first closure element 14 and/or the second closure element 15 with regard to the movement capability thereof, in which case motorized adjustment mechanisms for example can then be provided here. In particular in the situation when an output request for refrigerated goods is made by a user actuating a control element on the operating and display device 7, an adjustment of the closure elements 14 and/or 15 is then carried out by way of the control unit 16. In the non-actuated state and thus with no output request in effect the closure elements 14 and 15 are held closed.

In addition to the embodiment wherein the second closure element 15 can be opened and closed under automatic control by the control unit, provision can also be made especially in the case of said second closure element 15 that it can only be removed and inserted again manually by a user.

Figure 5:
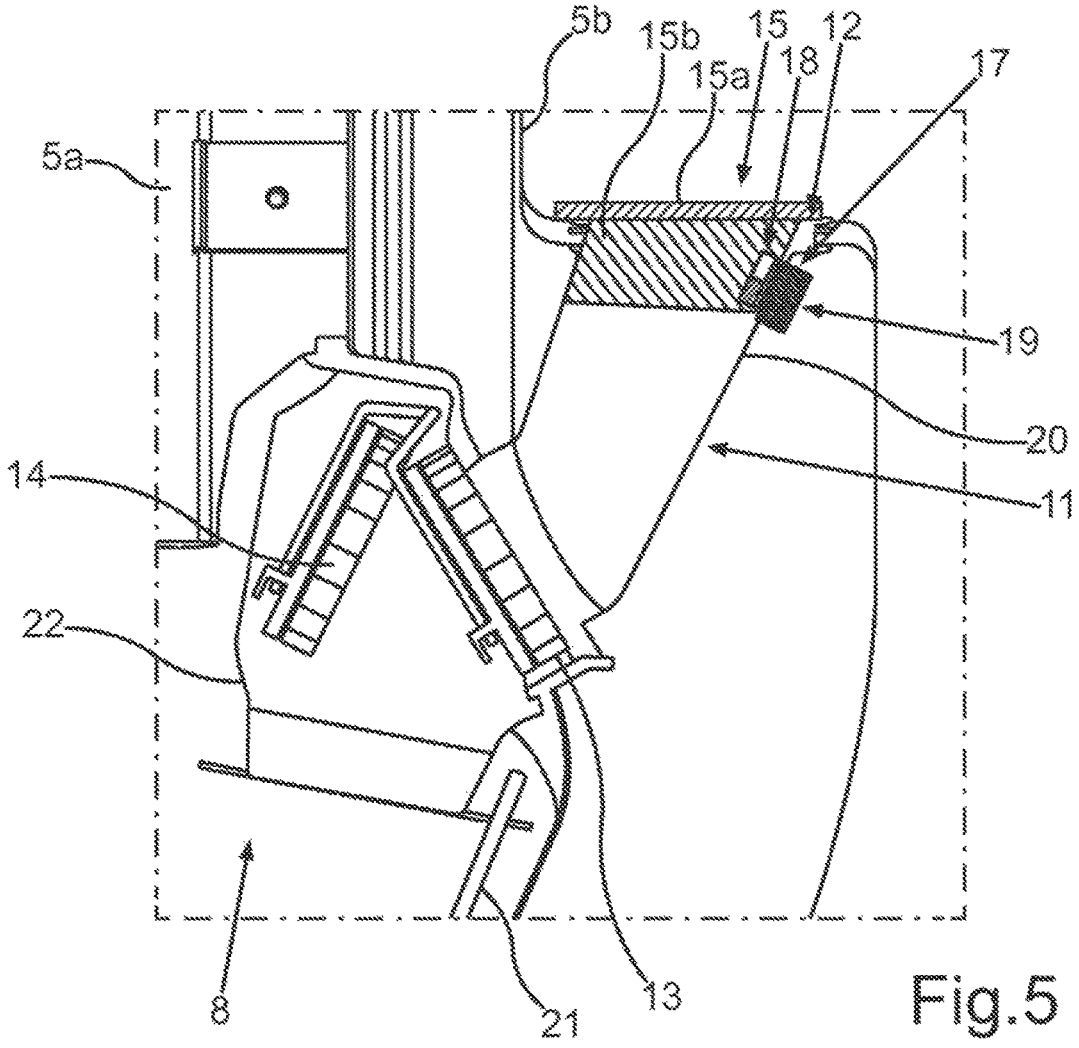
FIG. 5 shows an enlarged illustration of a subarea of the door according to FIG. 3 in the region of the discharge channel of a dispensing unit.

Especially in the case of such an exemplary embodiment, not only with this one however but also in the case of an embodiment with automatic control by way of the control unit 16, according to the illustration in FIG. 5 provision is made that the position or situation of the second closure element 15 can be detected by means of a detection unit 17 which is preferably connected to the control unit 16 for the purpose of electrical communication. In particular, provision is made that said detection unit 17 comprises a detection element 18 within the closure element, which operates in interaction with a detection element 19 outside the closure element. The detection element 19 outside the closure element is preferably arranged on the discharge channel 11. The detection elements 18 and 19 can interact inductively or capacitively or magnetically or optically.

In a further preferred exemplary embodiment, provision is made that the second closure element 15 has a base plate 15*a* and a thermally insulating element 15*b* surrounding the base plate 15*a* at least in certain zones. Provision can be made that the detection element 18 on the closure element side is arranged, in particular is integrated, in said thermally insulating element 15*b*, and in particular is completely surrounded by the material of the thermally insulating element 15*b*.

Provision can also be made that the second closure element 15 in a preferred embodiment covers the end 12 of the discharge channel 11 from above and thereby also extends outside the discharge channel 11 at least in certain zones. In an embodiment as is also explained in FIG. 5 by way of example provision can be made that the base plate 15*a* rests on the end 12 and the thermally insulating element 15*b* extends into the interior of the discharge channel 11.

In the case of such an embodiment, but not only such an embodiment, the second closure element 15 is then formed in the manner of a plug.

If the closure element 15 can then for example only be manually removed and inserted again by a user, it can be easily handled in this regard. Furthermore, the positionally secure arrangement preferably with a thermal insulation effect is worthy of mention.

FIG. 5 shows the opened state of the first closure element 14 which is a swivel-mounted flap.

Provision can likewise be made that the second closure element 15 is also a swivel-mounted flap. This is advantageous for example in the situation when automatic opening and closing by way of the control unit 16 is implemented.

Figure 6:
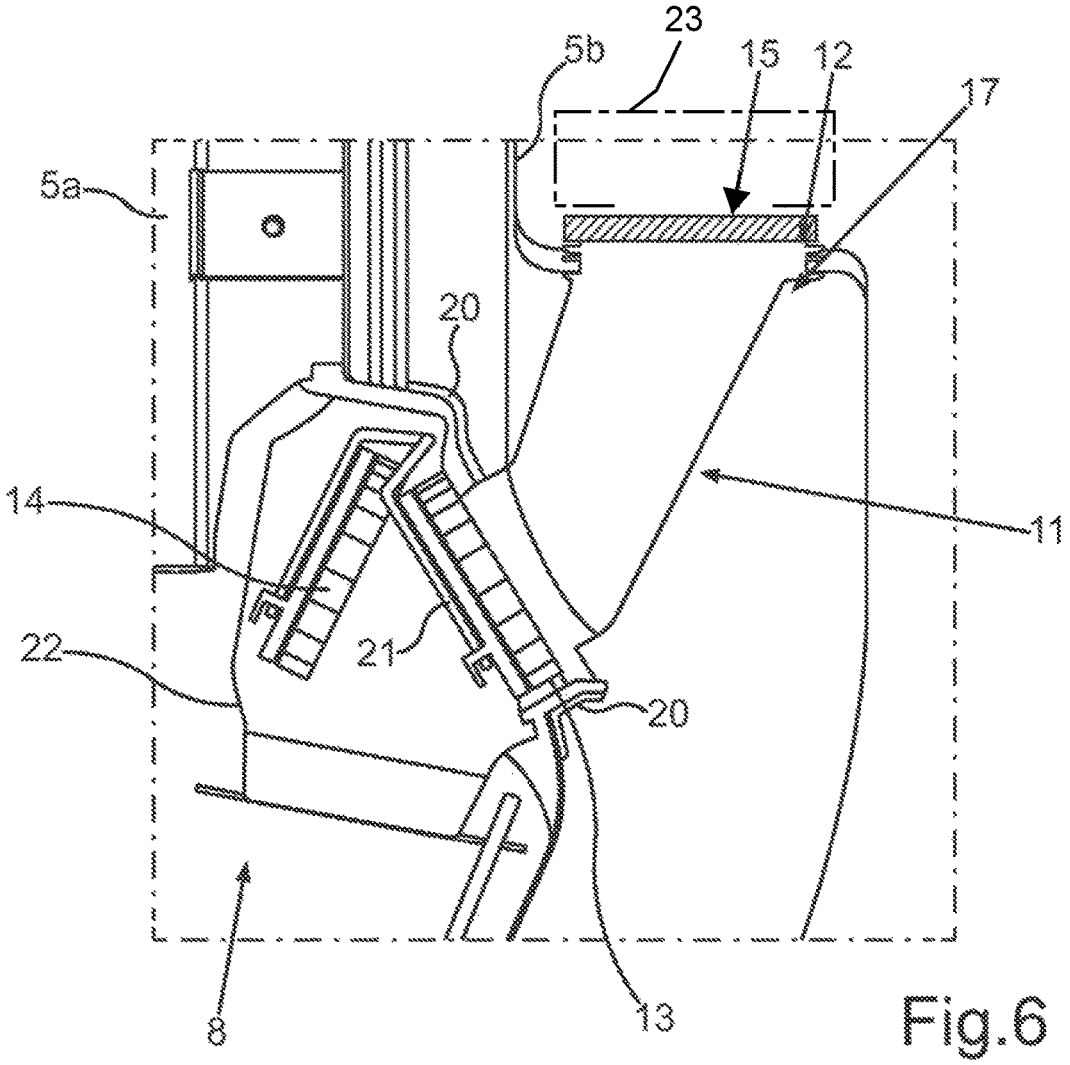
FIG. 6 shows an illustration according to FIG. 5 with a further exemplary embodiment of a second closure element.

FIG. 6 shows a further exemplary embodiment, corresponding to the embodiment and illustration in FIG. 5, in which the second closure element 15 covers the end 12 of the discharge channel 11 quasi only from above and otherwise does not extend into the discharge channel 11. In this embodiment, provision can be made that the closure element 15 is a horizontally movable lid element which is stable in shape in itself. It is however also possible especially with this embodiment to then make provision that the second closure element 15 is deformable in itself and is formed for example from a plurality of connected slats or the like, such that it can also be folded or rolled up on opening.

As can furthermore be seen in the illustrations in FIG. 5 and FIG. 6, a heater unit 20 is provided which can heat the discharge channel 11 at least in the region of the end 13 in order to at least reduce corresponding condensation in the discharge channel 11.

Additionally or alternatively it is furthermore possible to provide a further heater unit 21 which enables heating at least of the first closure element 14 itself.

Figure 7:
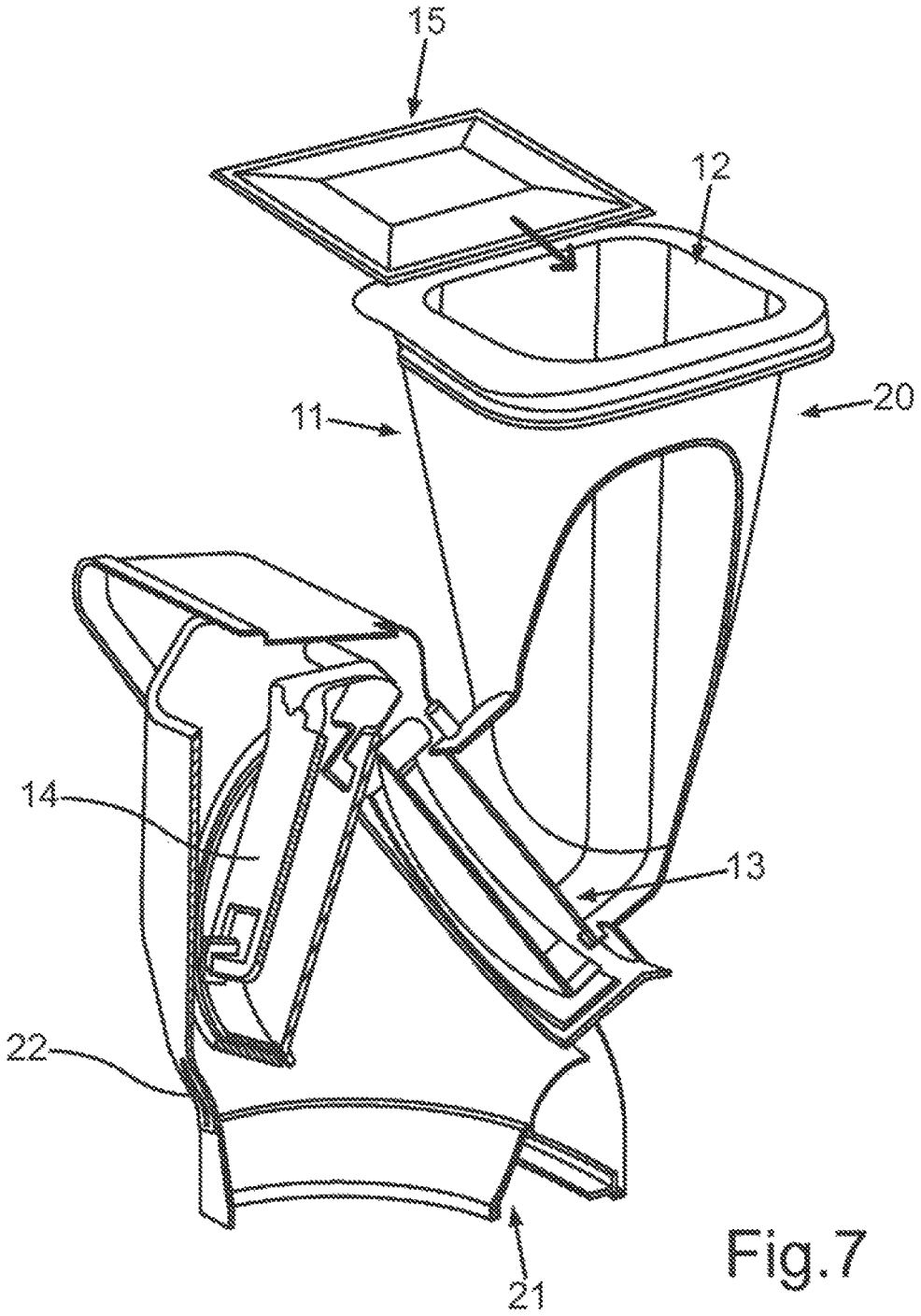
FIG. 7 shows a perspective sectional view of subcomponents of the embodiments in FIG. 5 and FIG. 6 of an opened condition of an exemplary embodiment of a second closure element.

FIG. 7 shows a perspective sectional view of the discharge channel 11 having an opened second closure element 15 and an opened first closure element 14.

Especially with the embodiments in which the second closure element 15 can only be manually removed and inserted again by a user it is advantageous if the control unit 16 detects the position of the second closure element 15 by way of the detection unit 17 and as a function thereof, if for example an output request for refrigerated goods has occurred but the second closure element 15 is still arranged in the condition closing the end 12, prevents said output, such that no refrigerated pourable goods are output from the container to the discharge channel 11. Likewise in the case of automatic control of the positional arrangement of the second closure element 15 the output of the refrigerated goods from the container to the discharge channel 11 takes place only when the second closure element 15 has been automatically opened and the first closure element 14 has been automatically opened. Provision is then made that the closure elements 14 and 15 are closed again immediately after the completion of output of the refrigerated goods.

In particular, as a result of the position of the second closure element 15 and the basic presence of said second closure element 15 the temperature rises in the discharge channel over its entire length, which means that said region automatically becomes warmer in a defined and desired manner. As a result the heat output of the heater unit 20 and/or the heat output of the heater unit 21 can be reduced and the energy-efficient operation of the entire domestic refrigerator 1 can thereby also be improved.

In addition to the aforementioned options for configuration and movement of the second closure element 15, apart from a swivel motion or a rectilinear movement or sliding action it is also possible to provide a rotation or the like. The second closure element 15 can also be formed in multiple parts and the individual parts moved relative to one another, such that here too a great diversity of configurations and movement scenarios can be enabled.

LIST OF REFERENCE CHARACTERS

1 Domestic refrigerator
2 Housing
3 Body
4 Door
5 Door
5*a* Outer surface
5*b* Inner surface
6 Dispensing unit
7 Operating and display device
8 Dispensing compartment
9 Dispensing facility
10 Receiving area
11 Discharge channel
12 Upper first end
13 End
14 Closure element
15 Closure element
15*a* Base plate
15*b* Thermally insulating element
16 Control unit
17 Detection unit
18, 19 Detection elements
20, 21 Heater units
22 Output nozzle

The invention claimed is:

1. A domestic refrigerator, comprising:

a receiving area for food;

a housing surrounding said receiving area, said housing having an exterior, said housing having an inner surface delimiting said receiving area and an outer surface opposite said inner surface;

a dispenser disposed in said housing and configured to dispense refrigerated pourable goods, said dispenser having a container for receiving the refrigerated goods, and said dispenser having a discharge channel coupled to said container for discharging the refrigerated goods from said container to said exterior of said housing, said discharge channel having a first end at said inner surface defining an inlet thereof and a second end at said outer surface defining an outlet thereof;

a first closure closing said outlet; and a second closure disposed at said inlet, said second closure being separate from said first closure and closing said inlet.

2. The domestic refrigerator according to claim 1, wherein said second closure projects regionally into said discharge channel beyond said first end of said discharge channel.

3. The domestic refrigerator according to claim 1, wherein said second closure is a plug.

4. The domestic refrigerator according to claim 1, wherein said second closure is configured for independent automatic closing and opening.

5. The domestic refrigerator according to claim 4, which further comprises:

a controller;

said controller being configured to control said automatic opening of said second closure depending on an output request to output refrigerated goods from said container; and said controller being configured to control said closing of said second closure after an output of the refrigerated goods has taken place.

6. The domestic refrigerator according to claim 5, wherein said controller is configured to suppress an output of refrigerated goods depending on a detection of a closed condition of said second closure.

7. The domestic refrigerator according to claim 5, which further comprises:

at least one of a heater providing a heat output for heating said discharge channel or a heater providing a heat output for heating said first closure;

said controller being configured to control said heat output from at least one of said heaters depending on a detection of a closed condition of said second closure.

8. The domestic refrigerator according to claim 1, which further comprises a detector for detecting a position of said second closure relative to said discharge channel.

9. The domestic refrigerator according to claim 8, wherein said detector is configured at least for inductive or capacitive detection at least of a closed condition of said second closure.

10. The domestic refrigerator according to claim 8, wherein said detector is configured at least for a magnetic detection at least of a closed condition of said second closure.

11. The domestic refrigerator according to claim 8, wherein said detector is configured for an optical detection at least of a closed condition of said second closure.

12. The domestic refrigerator according to claim 1, wherein said second closure has a side facing said first closure, and said second closure has a thermal insulator disposed at least at said side of said second closure facing said first closure.

* * * * *